US010495261B2

(12) United States Patent
Leigh et al.

(10) Patent No.: US 10,495,261 B2
(45) Date of Patent: Dec. 3, 2019

(54) CRYOSTAT ARRANGEMENTS AND MOUNTING ARRANGEMENTS FOR CRYOSTATS

(71) Applicant: Tesla Engineering Limited, Sussex (GB)

(72) Inventors: Benjamin David Leigh, Sussex (GB); Oliver Matthew Levantine, Sussex (GB)

(73) Assignee: Tesla Engineering Limited, Sussex (GB)

( * ) Notice: Subject to any disclaimer, the term of this patent is extended or adjusted under 35 U.S.C. 154(b) by 90 days.

(21) Appl. No.: 15/669,059

(22) Filed: Aug. 4, 2017

(65) Prior Publication Data

US 2019/0032855 A1 Jan. 31, 2019

(30) Foreign Application Priority Data

Jul. 25, 2017 (GB) ..... 1711970.2

(51) Int. Cl.
*F25B 9/00* (2006.01)
*F25B 9/10* (2006.01)
(Continued)

(52) U.S. Cl.
CPC ..... *F17C 13/087* (2013.01); *F25D 19/006* (2013.01); *F17C 3/085* (2013.01)

(58) Field of Classification Search
CPC ..... F25B 9/00; F25B 9/10; F25B 9/14; F25B 9/145; F17C 3/085; F17C 13/087; F25D 19/006
See application file for complete search history.

(56) References Cited

U.S. PATENT DOCUMENTS 3,306,075 A 2/1967 Cowans
4,344,302 A 8/1982 Jarrett, Jr. et al.
(Continued)

FOREIGN PATENT DOCUMENTS

EP 1279886 A2 1/2003
GB 2248490 A 4/1992
GB 2461893 A 1/2010

*Primary Examiner* — Frantz F Jules
*Assistant Examiner* — Erik Mendoza-Wilkenfel
(74) *Attorney, Agent, or Firm* — McCormick, Paulding & Huber LLP

(57) ABSTRACT

A cryocooler mounting arrangement and magnets and cryostats including such an arrangement. The arrangement is for mounting the coldhead 21 of a cryocooler 2 in a cryostat 1 for allowing the extraction of heat from the interior of the cryostat by the cryocooler. The mounting arrangement comprises a coldhead interface portion 22*a*, 22*b* for mounting on the coldhead 21 and a sock portion 3 for mounting in the cryostat 1 and arranged for receiving the coldhead 21. The sock portion 3 comprises a receiving interface portion 32*a*, 32*b* for receiving the coldhead interface portion so as to provide thermal contact therebetween and hence to provide thermal contact between the coldhead and the interior of the cryostat. The coldhead interface portion comprises plurality of flexible finger portions 23*a*, 23*b* and the receiving interface portion comprises a bearing surface 322*a*, 322*b* against which the finger portions are arranged to rest. The mounting arrangement further comprises a clamping ring 4*a*, 4*b* for releasably clamping the finger portions 23*a*, 23*b* against the bearing surface 322*a*, 322*b* to ensure thermal contact between the coldhead interface and the receiving interface. The clamping ring 4*a*, 4*b* is held in a recess on the fingers. An outer interface portion 5 is provided at the outer vacuum wall of the cryostat 1.

38 Claims, 7 Drawing Sheets

(51) Int. Cl.

| | |
|---|---|
| ***F25B 9/14*** | (2006.01) |
| ***F17C 13/08*** | (2006.01) |
| ***F25D 19/00*** | (2006.01) |
| *F17C 3/08* | (2006.01) |

(56) References Cited

U.S. PATENT DOCUMENTS

| | | | | |
|---|---|---|---|---|
| 4,667,487 | A | 5/1987 | Miller | |
| 5,682,751 | A | 11/1997 | Langhorn | |
| 5,853,198 | A * | 12/1998 | Richied | F16L 37/05 285/41 |
| 6,438,966 | B1 | 8/2002 | Sarwinski | |
| 2009/0272127 | A1* | 11/2009 | Radovinsky | F25D 19/006 62/50.7 |
| 2012/0073310 | A1 | 3/2012 | Radovinsky | |
| 2013/0192034 | A1* | 8/2013 | Mitsubori | F25B 41/04 29/213.1 |

* cited by examiner

CRYOSTAT ARRANGEMENTS AND MOUNTING ARRANGEMENTS FOR CRYOSTATS

This invention relates to cryostat arrangements, mounting arrangements for cryostats and magnet arrangements including such cryostat arrangements or mounting arrangements.

Whilst more broadly applicable than this, the current ideas are of particular interest in the provision of superconducting magnet arrangements, in particular for use in MRI (magnetic resonance imaging). As is well understood, in such magnets it is generally necessary to cool the superconducting magnet down to a low temperature to achieve superconducting behaviour. Thus in such magnet arrangements the superconducting magnet is housed in a cryostat and a cooling arrangement is providing for cooling the magnet down to an operating temperature and maintaining the magnet at a superconducting temperature during operation.

Some form of cryocooler is typically used in order to take the magnet down to its operating temperature and to maintain it at its operating temperature. Sometimes the same cryocooler may be used for both of these operations. In other circumstances however, a cryocooler used in initial cool down will be different than one used in ongoing operation. Even in circumstances where there is no desire to switch between cryocoolers for different stages in the life of the cryostat, there is a general requirement to install cryocoolers, and from time-to-time a requirement for performing maintenance and/or the replacement of cryocoolers if some kind of problem or failure occurs.

Thus there is a general desirability to provide for convenient installation and removal of cryocoolers. Furthermore it is desirable if such installation and removal can take place whilst the cryostat is still at a cold temperature, say its operating temperature or close thereto.

At the same time it is important that good thermal contact is maintained between the coldhead of the cryocooler and the interior of the cryostat during cooling operation of the cryocooler. That said, it will be appreciated that other than at locations where this good thermal contact is required, there is a general desire to minimise thermal conduction paths from the interior of the cryostat to the exterior.

Thus it is with this background of issues and preferable features that the present system has been developed.

According to one aspect of the present invention there is provided a cryocooler mounting arrangement for mounting the coldhead of a cryocooler in a cryostat for allowing the extraction of heat from the interior of the cryostat by the cryocooler, the mounting arrangement comprising a coldhead interface portion for mounting on the coldhead and a sock portion for mounting in the cryostat and arranged for receiving the coldhead, the sock portion comprising a receiving interface portion for receiving the coldhead interface portion so as to provide thermal contact therebetween and hence to provide thermal contact between the coldhead and the interior of the cryostat, wherein one of the coldhead interface portion and the receiving interface portion comprises plurality of flexible finger portions and the other of the coldhead interface portion and the receiving interface portion comprises a bearing surface against which the finger portions are arranged to rest and the mounting arrangement further comprises a clamping ring for releasably clamping the finger portions against the bearing surface to ensure thermal contact between the coldhead interface and the receiving interface.

According to another aspect of the present invention there is provided a cryostat arrangement comprising a cryostat and a cryocooler having a coldhead for mounting in the cryostat for allowing the extraction of heat from the interior of the cryostat by the cryocooler, the cryostat arrangement comprising a coldhead interface portion provided on the coldhead and a sock portion mounted in the cryostat and arranged for receiving the coldhead, the sock portion comprising a receiving interface portion for receiving the coldhead interface portion so as to provide thermal contact therebetween and hence to provide thermal contact between the coldhead and the interior of the cryostat, wherein one of the coldhead interface portion and the receiving interface portion comprises plurality of flexible finger portions and the other of the coldhead interface portion and the receiving interface portion comprises a bearing surface against which the finger portions are arranged to rest and the mounting arrangement further comprises a clamping ring for releasably clamping the finger portions against the bearing surface to ensure thermal contact between the coldhead interface and the receiving interface.

This arrangement allows the easy introduction of a cryocooler into the cryostat and removal of a cryocooler from the cryostat whilst providing good thermal contact between the coldhead and the interior of the cryostat. This means, for example, that different cryocoolers can easily be used at different times—for example at initial cooldown compared to ongoing operation, and initial set up and maintenance are facilitated.

The clamping ring may be arranged to contract in response to the ambient operating temperature in the cryostat to provide the clamping action. The clamping ring may be of PTFE (Polytetrafluoroethylene).

Heating means may be provided for heating the clamping ring to cause expansion thereof for aiding in the release and/or location of the finger portions on the bearing surface. The heating means may comprise a heating wire carried by the clamping ring.

The receiving interface portion, the coldhead interface portion and the clamping ring may be arranged so that at room temperature the interface portions may be freely engaged and disengaged without interference from the clamping ring whereas the clamping ring clamps the fingers against the bearing surface at the ambient operating temperature in the cryostat.

Retaining means may be provided for retaining the clamping ring in position for acting on the fingers. An initially proposed form of retaining means comprises clips that are provided on the respective interface portion and project over and around the ring to hold it in position. However it has been found that such a form of retaining means has disadvantages in that it increases the outside diameter of at the interface portion which can lead to a larger overall design and increased heat leakage. Thus an alternative is preferable.

Preferably the clamping ring is carried on the interface portion comprising the plurality of fingers and held in position by respective retaining shoulder portions provided on at least one (preferably at least two) of the plurality of fingers. Respective shoulder portions may be provided to resist movement of the clamping ring in one axial direction or both axial directions. The at least one (or the preferred at least two) of the plurality of fingers may comprise a respective recess in which the clamping ring is located for holding the clamping ring in position. Respective recesses may be provided in each of the fingers.

This can provide a particularly compact design.

The interface portion comprising the plurality of fingers may comprise a cup shaped portion with a first radially extending portion and depending from this a flared cylindrical portion which comprises the plurality of fingers.

This arrangement can ease fitting of the interface portion to the coldhead or sock where appropriate and/or can help facilitate the provision of spacing between the coldhead and the sock to minimise undesirable heat transfer therebetween. It can also lead to a more robust design that is better able to withstand multiple clamping and unclampings of the finger portions.

The cup shaped portion may be of a single piece of material.

The bearing surface may be conical and the fingers may be arranged so as to lie on a complementary conical surface so that in engaging the interfaces the fingers slide over the bearing surface. This can aid engagement of the interfaces and allow of accommodation of manufacturing tolerances and thermal expansion and contraction whilst good thermal contact is maintained.

The coldhead interface may comprise the plurality of fingers and the receiving interface may comprise the bearing surface.

The plurality of fingers may be arranged to surround the bearing surface.

A pair of coldhead interfaces may be provided and a corresponding pair of receiving interfaces may be provided, with a first of the coldhead interfaces for engagement with a first of the receiving interfaces and a second of the coldhead interfaces for engagement with a second of the receiving interfaces.

The cryostat may be a multistage cryostat and the first of the receiving interfaces may be associated with a first stage of the cryostat for extracting heat from the first stage and the second of the receiving interfaces may be associated with a second stage of the cryostat for extracting heat from the second stage.

The mounting arrangement or cryostat arrangement may comprise a ring-like outer interface arrangement for location between the cryocooler and an outer wall of the cryostat, the ring-like outer interface arrangement being arranged to be located around an aperture in the outer wall of the cryostat through which the coldhead passes when located into the sock.

The outer interface arrangement may comprise a cable passage for providing a path for electrical cables from the exterior into the interior of the sock.

The outer interface arrangement may comprise a piston seal portion with at least one seal arranged for sealing on an axial surface of at least one of the outer interface arrangement, a wall of the cryostat, and the sock for creating a vacuum seal whilst allowing tolerance in the relative axial position of the seal and said axial surface.

This can allow clamping of the cryocooler and interface arrangement to the cryostat so as to provide a vacuum seal whilst tolerating build variations/errors.

According to another aspect of the invention there is provided a magnet arrangement comprising a cryostat arrangement as defined above comprising a superconducting magnet housed in the cryostat. It will be appreciated that in such a case the magnet can take the role of a cold mass to be cooled by the cryocooler.

The magnet arrangement may be an MRI (magnetic resonance imaging) magnet arrangement.

According to a further aspect of the present invention there is provided a cryocooler mounting method for mounting the coldhead of a cryocooler in a cryostat for allowing the extraction of heat from the interior of the cryostat by the cryocooler, the method comprising the steps of:

providing a coldhead interface portion on the coldhead;

providing a sock portion in the cryostat, which sock portion is arranged for receiving the coldhead, the sock portion comprising a receiving interface portion for receiving the coldhead interface portion so as to provide thermal contact therebetween and hence to provide thermal contact between the coldhead and the interior of the cryostat;

wherein one of the coldhead interface portion and the receiving interface portion comprises plurality of flexible finger portions and the other of the coldhead interface portion and the receiving interface portion comprises a bearing surface against which the finger portions are arranged to rest and the method comprises the further steps of locating the finger portions on the bearing surface; and releasably clamping the finger portions against the bearing surface using a clamping ring to ensure thermal contact between the coldhead interface and the receiving interface.

Embodiments of the present invention will be described, by way of example only, with reference to the accompanying drawings in which.

Figure 4:
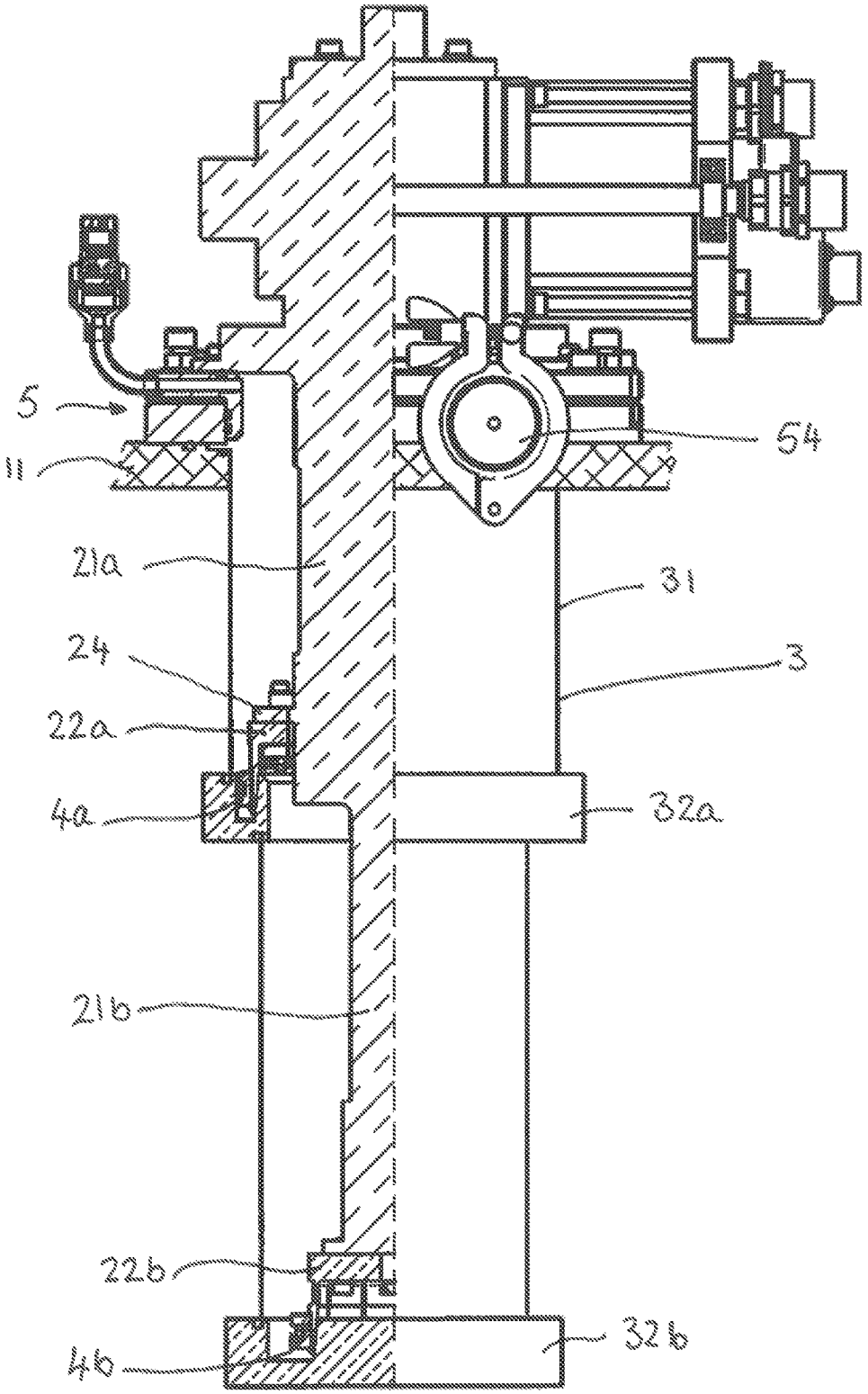
FIG. 4 shows the cryocooler of FIGS. 1 and 2 located in position in the cryostat in a sock provided in the cryostat with part of the sock and cryocooler cut away so as to better show various features of the arrangement.
Figure 5A:
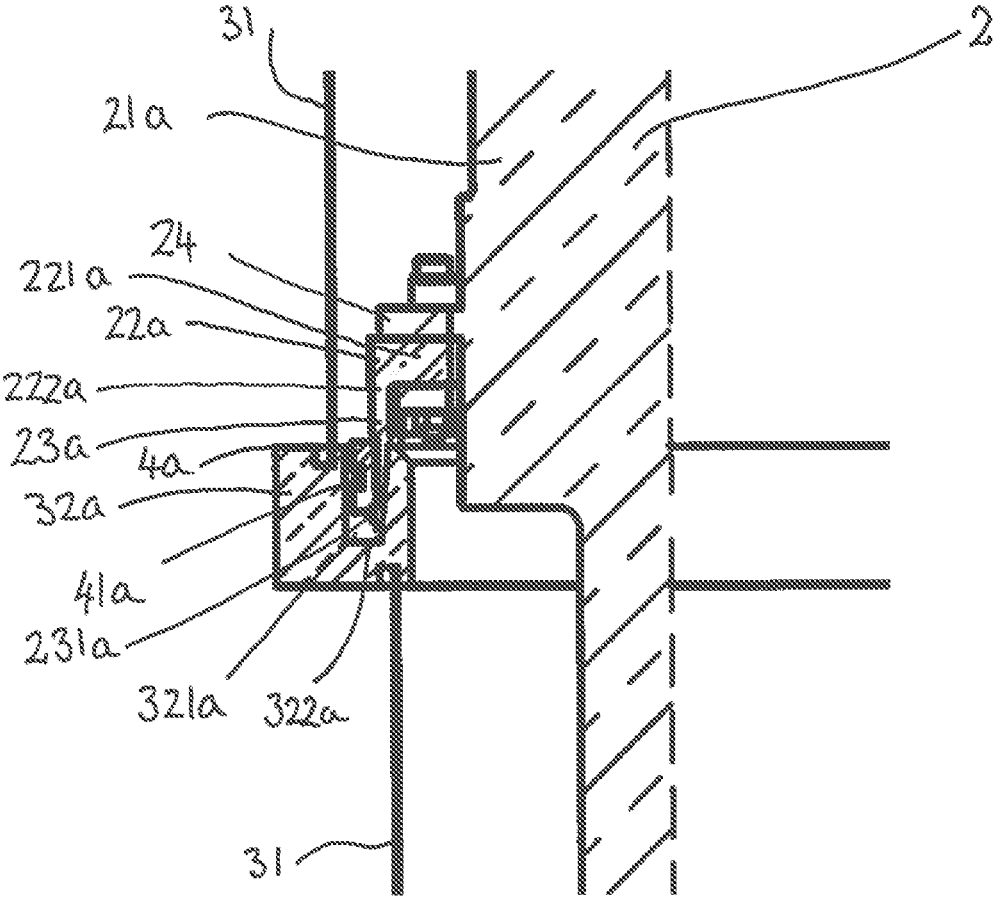
Figure 5B:
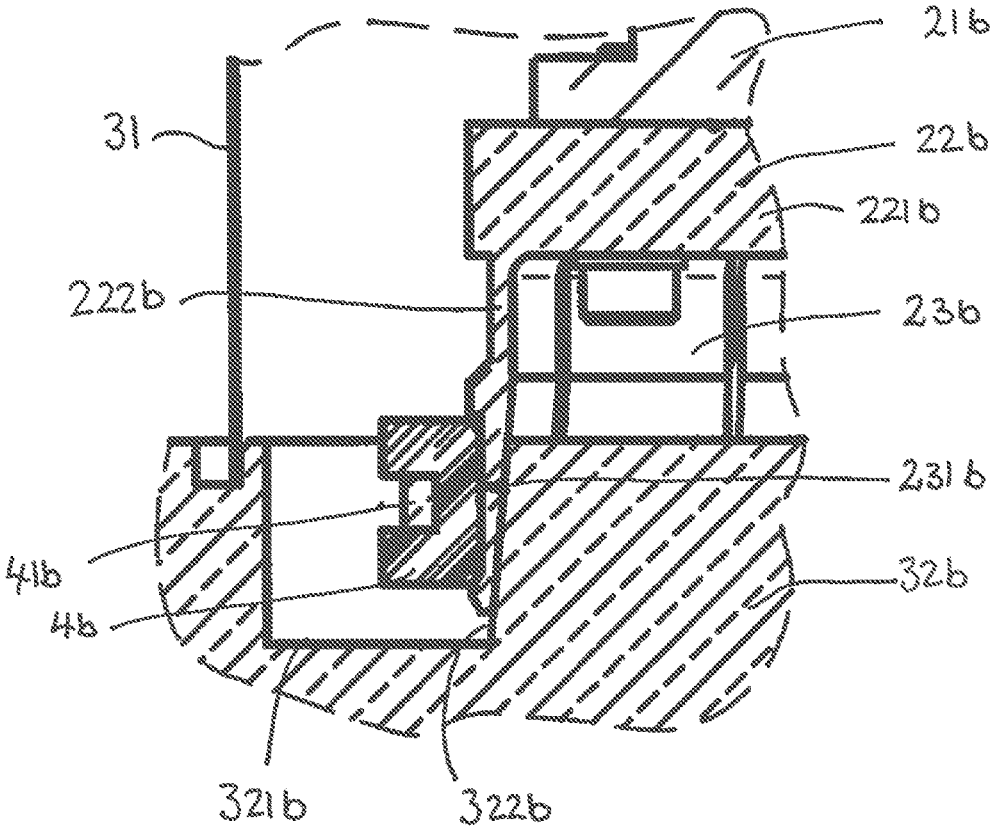
Figure 6:
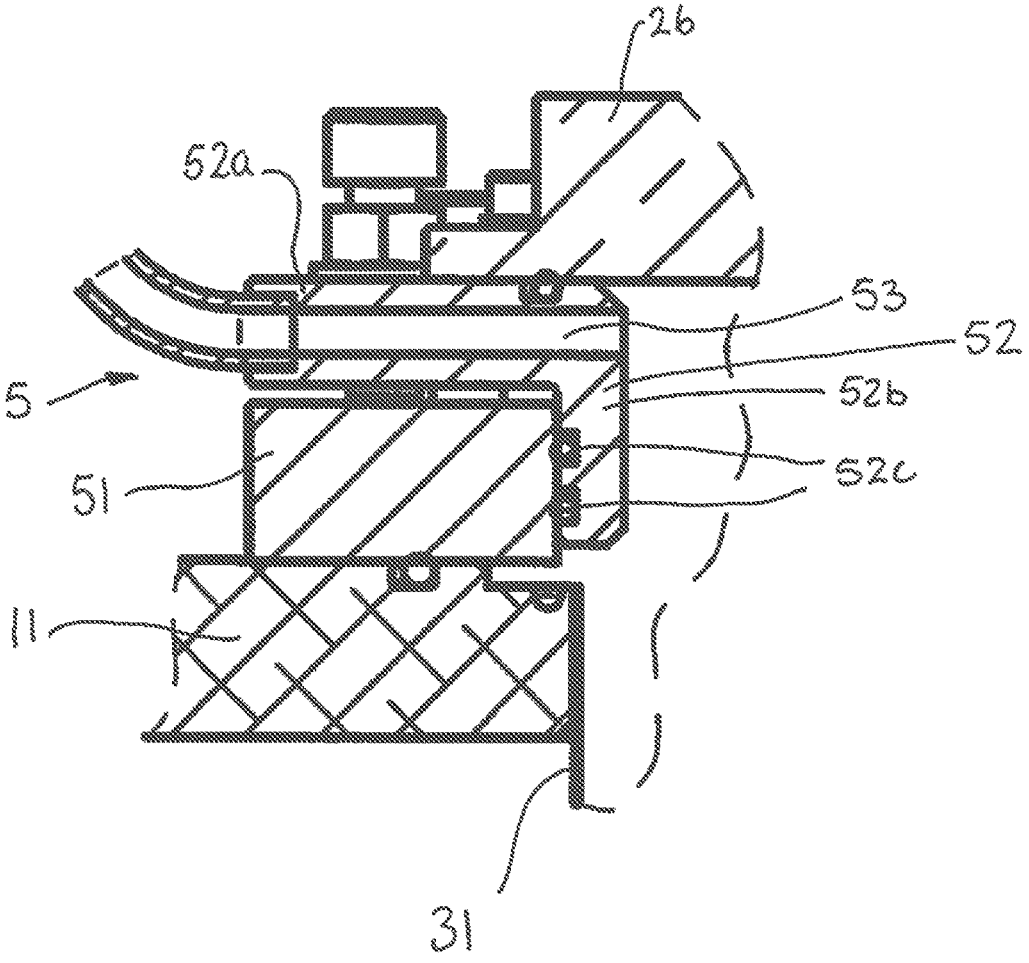

FIGS. 5A and 5B show respective enlarged portions of part of the cryocooler and sock shown in FIG. 4 each better showing a respective interface between a coldhead of the cryocooler and the sock; and FIG. 6 shows another enlarged part of the arrangement shown in FIG. 4 more dearly showing an outer interface arrangement between the coldhead of the cryocooler and an outer vacuum chamber wall of the cryostat.

Figure 1:
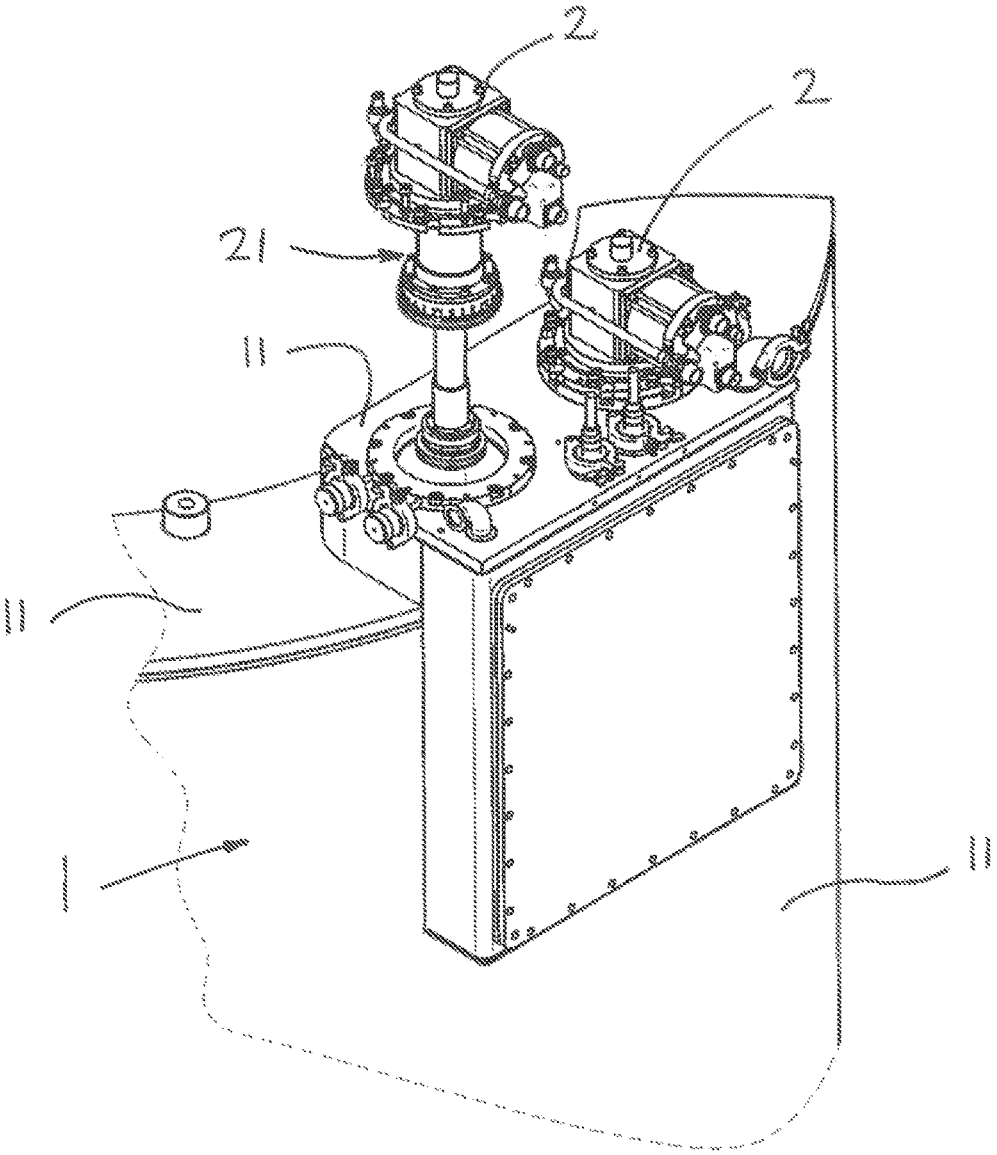
FIG. 1 shows part of a magnet arrangement including a cryocooler which is just about to be inserted in position in the cryostat.

FIG. 1 shows a superconducting magnet arrangement which in this case is an MRI superconducting magnet arrangement. The magnet arrangement comprises a cryostat 1 in which is housed a superconducting magnet M (see FIG. 3) as a cold mass to be maintained at a sub-zero temperature. As will be appreciated, the temperature at which the magnet is maintained will depend on the particular magnet design and, for example, the materials used therein. In the present case the superconducting magnet is to be maintained at liquid helium temperatures, that is to say at in the order of 4 Kelvin.

The magnet arrangement further comprises at least one cryocooler 2, in this case, two such cryocoolers 2 are provided. Together the cryostat 1 and the cryocoolers 2 can be considered to constitute a cryostat arrangement.

In FIG. 1, one of the cryocoolers 2 is shown in a position just before insertion into the cryostat 1. The other cryocooler 2 is shown located in position in the cryostat 1.

As will be appreciated, different types of cryocooler may be used. Thus, for example a Gifford-McMahon (GM) cryocooler may be used or a pulse tube (PT) cryocooler may be used. In a particular implementation which is currently of interest for the applicants, one of these types of cryocoolers will be used in an initial cooldown stage whereas the other type will be used for ongoing operation of the cryostat. In other cases two different cryocoolers which are both of the same type, but with differing performance characteristics may be similarly used. As will be explained in more detail below, the present magnet arrangement/cryostat arrangement facilitates this type of interchange of cryocoolers. Moreover this is facilitated whilst the cryostat 1 may be maintained at a cold, ie operating temperature, and correspondingly whilst the insulating vacuum in the cryostat is maintained.

Figure 2:
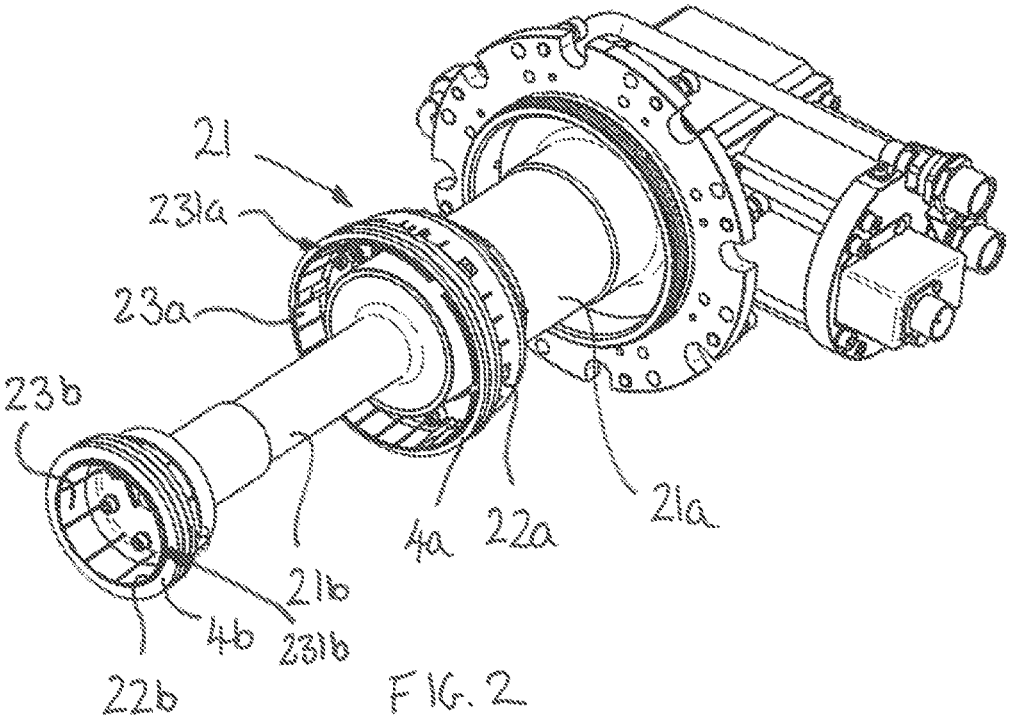
FIG. 2 shows the cryocooler which is shown as about to be inserted in the cryostat in FIG. 1 but in isolation.
Figure 3:
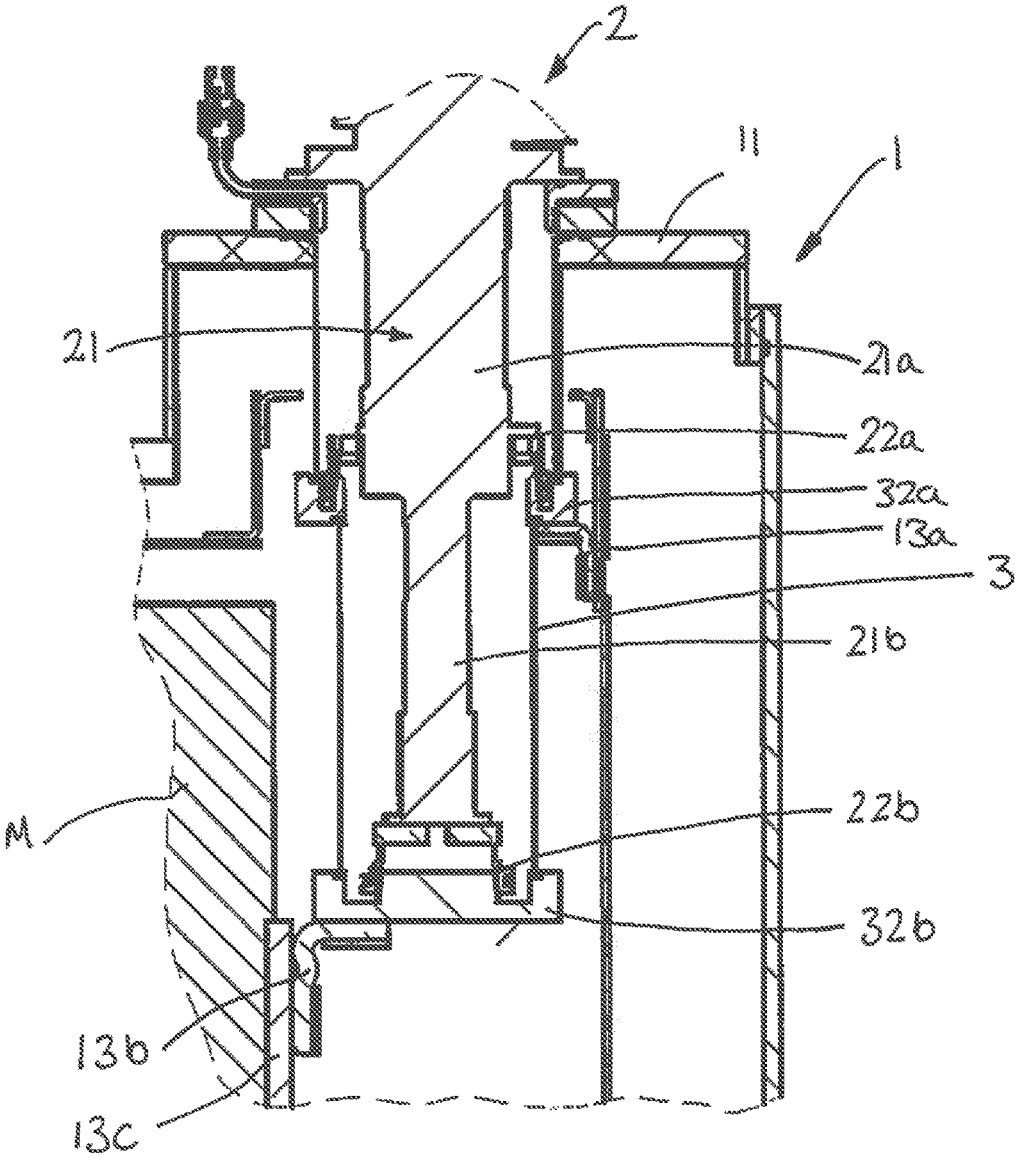
FIG. 3 is a section showing the cryocooler of FIGS. 1 and 2 in situ in the cryostat—part of the cryocooler and part of the cryostat are visible but both in simplified form due to the scale.

FIG. 2 shows one of the cryocoolers 2 of FIG. 1 in isolation whereas FIGS. 3 and 4 show the cryocooler 2 when inserted in position in a sock 3 provided within the cryostat 1. The cryocooler 2 comprises a coldhead 21 which is arranged for insertion into the sock 3 and which moreover is arranged for extracting heat from elements which come into thermal contact with the coldhead. The design and operation of such cryocoolers is well understood and commercially available cryocoolers may be used in the device of the present invention. Thus any further description of the structure and operation of cryocoolers is not necessary and therefore omitted from this specification in the interests of brevity.

In the present case the cryocooler 2 is a two stage cryocooler having a first stage 21*a* for providing cooling down to a first temperature and a second stage 21*b* for providing cooling down to a second cooler temperature. A first coldhead interface portion 22*a* is provided on the first stage 21*a* and a second coldhead interface portion 22*b* is provided on the second stage 21*b*.

Referring to FIGS. 3 to 5A and 5B, the first stage coldhead interface portion 22*a* is arranged for thermally contacting with a first stage sock interface portion 32*a* and the second stage coldhead interface portion 22*b* is arranged for thermally contacting with a second stage sock interface portion 32*b*.

These respective pairs of interface portions (22*a*, 32*a* on the one hand and 22*b*, 32*b* on the other hand) provide thermal conduction paths between the respective stages of the coldhead 21 and the cryostat 1.

The cryostat comprises an outer vacuum chamber wall 11 and nested within that a radiation shield 12. The cold mass—the magnet M—is housed within the radiation shield 12. The sock 3 projects through the outer vacuum chamber wall 11 and through the radiation shield 12.

The first stage sock interface portion 32*a* is coupled via a first thermal link 13*a* to the radiation shield 12. The second stage sock interface portion 32*b* is coupled to the cold mass M via a second thermal link 13*b* and a thermal interface 13*c*. Both of the thermal links 13*a*, 13*b* are flexible to allow for thermal expansion and contraction and build tolerances.

The present embodiment relates to a system with a conduction cooled magnet, ie a system which is cryogen free. In alternatives with an arrangement containing helium, the flexibility would be provided by an arrangement of bellows, and the interface of the appropriate stage of the cryocooler would be to a "condenser" which transforms cryogen vapour into liquid by the extraction of heat.

The sock 3 comprises thin walled cylindrical housing portions 31 running from the outer vacuum chamber wall 11 of the cryostat down into the body of the cryostat. The cylindrical sock walls 31 are sealed to the outer vacuum chamber wall 11 of the cryostat. These curved wall portions 31 are kept as thin as possible to minimise the conduction path from the interior of the cryostat out to the exterior. At the same time they provide a vacuum chamber within the cryostat within which the coldhead 21 resides. The sock 3 terminates with the second stage interface portion 32*b* such that the interior of the sock 3 is sealed from the interior of the cryostat.

The coldhead interface portions 22*a*, 22*b* and the sock interface portions 32*a*, 32*b* are shown at a larger scale in FIGS. 5A and 5B. The first stage coldhead interface portion 22*a* and a first stage sock interface portion 32*a* have a similar form to the second stage coldhead interface portion 22*b* and second stage sock interface portion 32*b* respectively.

Each of the coldhead interface portions 22*a*, 22*b* is generally cup-shaped as can be seen by a consideration of FIGS. 2 to 5A and 5B. They each have a first radially extending portion 221*a*, 221*b* and in each case depending from this a respective flared cylinder portion 221*b*, 222*b*. Each of the flared cylinder portions 221*b*, 222*b* comprises a respective plurality of flexible finger portions 23*a*, 23*b*. There is an axial aperture in each of the cup-shaped portions. The coldhead 21 passes through the aperture in the first stage coldhead interface portion 22*a*. The aperture in the second stage coldhead interface portion 22*b* exposes the end of the coldhead 21 to which the interface portion 22*b* is mounted.

In each case the coldhead interface portions 22*a*, 22*b* comprising the radially extending portions 221*a*, 221*b* and depending cylindrical portions 222*a*, 222*b* are formed of a single piece of material. Thus each of the plurality of fingers 23*a*, 23*b* is formed integrally with the respective radially extending portion 221*a*, 221*b* and this leads to a particularly robust design.

The first stage interface portion 22*a* is mounted to a flange 24 provided on the coldhead 21. The second stage interface portion 22*b* is mounted to the end of 25 of the coldhead 21. Note that this particular construction is born out of the fact that in the example shown in the drawings, the coldhead 21 is a commercially available component to which the interface portions have been added. In an alternative, a specially produced coldhead 21 (or whole cryocooler 2) might be provided in which case the interface portions 22*a*, 22*b* could be integrally formed with the housing of the coldhead if so desired.

The first and second stage sock interface portions 32*a*, 32*b* respectively include an annular recess 321*a*, 321*b* into which the flexible fingers 23*a*, 23*b* of the respective coldhead interface 22*a*, 22*b* can extend. Furthermore the first and second stage sock interfaces 32*a*, 32*b* include a bearing surface 322*a*, 322*b* against which the respective set of flexible fingers 23*a*, 23*b* bears when the respective interface portions 22*a* and 32*a*, 22*b* and 32*b* are engaged. Each bearing surface 322*a*, 322*b* corresponds to a side wall of the respective annular recess.

The bearing surfaces 322*a*, 322*b* are tapered, that is to say they lie on a conical surface. Inner engaging walls of the respective flexible fingers 23*a*, 23*b* define a complementary taper, that is to say they lie on a complementary conical surface. The surfaces are such that engagement between the interfaces is facilitated and good mechanical and therefore thermal contact between the interface portions can be obtained even where there is axial variation in position between the coldhead interface 22*a*, 22*b* on the one hand the respective sock interface 32*a*, 32*b* on the other hand. It will be appreciated that due to thermal expansion and contraction there can be a tendency for some such axial variation to occur. Further this arrangement also can allow for manufacturing tolerances between cryocoolers of the same type as well as dimensional differences between cryocoolers of differing types.

A clamping ring 4*a* is provided for clamping the fingers 23*a* of the first stage coldhead interface 22*a* to the respective bearing surface 322*a* of the first stage sock interface 32*a* and similarly a clamping ring 4*b* is provided for clamping the fingers 23*b* of the second stage coldhead interface 22*b* to the respective bearing surface 322*b* of the second stage sock interface 32*b*.

Each clamping ring 4*a*, 4*b* comprises a ring of material which is arranged to contract at the cold operating temperatures of the cryostat arrangement for clamping the fingers 23*a*, 23*b* into position on the respective sock interface 32*a*, 32*b*. In the present embodiments each clamping ring is of PTFE. Further each clamping ring 4*a*, 4*b* carries a respective heating wire 41*a*, 41*b* which can be used for locally heating the clamping ring 4*a*, 4*b* so causing it to expand and thus reduce its clamping force on the respective fingers 23*a*, 23*b*. As will be appreciated, this can facilitate the engagement of the respective interface portions as well as allow disengagement.

Thus overall this provides a particularly convenient mechanism for allowing quick and easy achievement of thermal contact between the coldhead 21 and the interior of the cryostat 1 when desired and similarly allows quick and easy breaking of such contact and therefore facilitates removal of the coldhead 21 and cryocooler 2 as a whole when desired.

In the present design, each clamping ring 4*a*, 4*b* is held in position on the respective sets of flexible fingers 23*a*, 23*b* by virtue of being retained in a respective recess 231*a*, 231*b* provided in the outer wall of the flexible fingers. This recess gives rise to corresponding shoulder portions at each end of the recess which act on the respective clamping ring 4*a*, 4*b* to hold it in position against axial movement. This provides a particularly compact design, especially over an originally proposed arrangement where the clamping rings where held in position with clip portions which extended out over the clamping rings. In turn, this allows the production of a more compact design where the diameter of the sock 3 can be minimised.

It will be noted that in the present arrangement the second stage coldhead interface portion 22*b* and its corresponding clamping portion 4*b* need to pass through an internal diameter of the first stage sock interface portion 32*a*. Thus if the overall outside diameter of the second stage coldhead interface portion 22*b* and its clamping portion 4*b* is larger, this may call for a disproportionately large internal diameter of the first stage sock interface portion 32*a*. By avoiding this, a smaller overall sock design can be achieved which helps reduce thermal leakage paths between the interior of the cryostat and the exterior by virtue of a reduced size and therefore reduced material in the sock 3.

As most clearly seen in FIG. 6, but also illustrated for example in FIG. 4, an outer interface arrangement 5 is provided for mounting the cryocooler 2 to the outer vacuum chamber wall 11 of the cryostat 1.

The outer interface arrangement 5 comprises a ring-like interface flange 51 which is bolted in position on the outer vacuum chamber 11. The outer interface arrangement 5 further comprises a piston seal portion 52 which again is ring-like and arranged to be disposed between a mounting flange 26 of the cryocooler 2 and the interface flange 51. The piston seal portion 52 comprises a radially extending portion 52*a* and an axially extending portion 52*b* carrying at least one seal 52*c* which bears on an axial surface for sealing the interior of the sock portion 3 from the exterior. Said axial surface in the present embodiment is an axial surface of the interface flange 51 but in other circumstances it may be an axial surface of the outer vacuum chamber wall 11 or the sock 3. Having the piston seal portion 52 seal on an axial surface has an advantage in that an effective seal can be obtained whilst there is quite a large degree of tolerance as to the axial position of the piston seal portion 52 relative to the other components. Thus again this can allow for thermal expansion and contraction and for differences in nominal dimensions whether these be due to the presence of different cryocoolers or due to manufacturing tolerances/errors.

Specifically it will be noted that by virtue of the piston seal portion 52, a vacuum seal may be provided for the sock 3 with the coldhead 21 positioned at a range of axial positions relative to the sock. In a current design of the applicant's, a tolerance of say +/−2 millimetres might be provided. This is important as it allows the clamping of the cryocooler 2 in position whilst recognising that accurate and complete engagement between the respective interface portions 22*a*, 32*a* and 22*b*, 32*b* between the coldhead 2 and the sock 3 is the ultimate aim.

It will also be appreciated that such a piston seal portion 52 might be used without an interface flange 51 clamped in position. That is to say in the circumstance where the piston seal portion 52 seals on an axial surface of the outer vacuum chamber wall 11 or an axial surface of the sock wall 31, it may be possible to dispense with the ring-like interface flange 51.

The outer interface arrangement 5 also comprises a through passage 53 to allow the introduction of electrical cables into the interior of the sock 3 from the exterior. This allows instrumentation to be permanently attached to the coldhead 21. Further it allows such instrumentation to be serviceable by removing the coldhead 21, and avoids connections having to be made during service operations within the sock 3. Further the interface arrangement 5 also comprises vacuum ports 54 (see FIG. 4) for allowing the introduction or extraction of gas from the interior of the sock 3.

To complete vacuum sealing, other seals are provided between components of the outer interface arrangement 5 and each other as well as between the components and the sock/outer vacuum wall and the coldhead, but it is the seals 52*c* on the axial surface that provide the axial tolerance in mounting of the coldhead.

The piston seal portion 52 comprises a plurality of scalloped portions arranged to register with bolts provided in the ring-like interface portion 51 to allow access to these bolts even when the cryocooler 2 and hence piston seal portion 52 are in position.

The invention claimed is:

1. A cryocooler mounting arrangement for mounting a coldhead of a cryocooler in a cryostat for allowing the extraction of heat from an interior of the cryostat by the cryocooler, the mounting arrangement comprising a coldhead interface portion for mounting on the coldhead and a sock portion for mounting in the cryostat and arranged for receiving the coldhead, the sock portion comprising a receiving interface portion for receiving the coldhead interface portion so as to provide thermal contact between the receiving interface portion and the coldhead interface portion and to provide thermal contact between the coldhead and the interior of the cryostat, wherein the coldhead interface portion comprises a plurality of flexible finger portions and the receiving interface portion comprises a bearing surface against which the finger portions are arranged to rest, wherein the receiving interface portion further includes an annular recess into which the plurality of flexible finger portions of the coldhead interface extend, and the mounting arrangement further comprises a clamping ring for releasably clamping the finger portions against the bearing surface to ensure thermal contact between the coldhead interface and the receiving interface.

2. A cryostat arrangement comprising a cryostat and a cryocooler having a coldhead for mounting in the cryostat for allowing the extraction of heat from an interior of the cryostat by the cryocooler, the cryostat arrangement comprising a coldhead interface portion provided on the coldhead and a sock portion mounted in the cryostat and arranged for receiving the coldhead, the sock portion comprising a receiving interface portion for receiving the coldhead interface portion so as to provide thermal contact between the receiving interface portion and the coldhead interface portion and to provide thermal contact between the coldhead and the interior of the cryostat, wherein the coldhead interface portion comprises a plurality of flexible finger portions and the receiving interface portion comprises a bearing surface against which the finger portions are arranged to rest, wherein the receiving interface portion further includes an annular recess into which the plurality of flexible finger portions of the coldhead interface extend, and the mounting arrangement further comprises a clamping ring for releasably clamping the finger portions against the bearing surface to ensure thermal contact between the coldhead interface and the receiving interface.

3. A cryocooler mounting arrangement according to claim 1 comprising retaining means for retaining the clamping ring in position for acting on the fingers, wherein the retaining means comprises a respective retaining shoulder portion provided on at least one of the plurality of fingers.

4. A cryocooler mounting arrangement according to claim 1 in which at least one of the plurality of fingers comprises a respective recess in which the clamping ring is located for holding the clamping ring in position.

5. A cryocooler mounting arrangement according to claim 4 in which a respective recess is provided in each of the fingers.

6. A cryocooler mounting arrangement according to claim 1 in which the interface portion comprising the plurality of fingers comprises a cup shaped portion with a first radially extending portion and, depending from the cup shaped portion, a flared cylindrical portion which comprises the plurality of fingers.

7. A cryocooler mounting arrangement according to claim 6 in which the cup shaped portion is of a single piece of material.

8. A cryocooler mounting arrangement according to claim 1 further comprising a ring-like outer interface arrangement for location between the cryocooler and an outer wall of the cryostat, the ring-like outer interface arrangement being arranged to be located around an aperture in the outer wall of the cryostat through which the coldhead passes when located into the sock.

9. A cryocooler mounting arrangement according to claim 8 in which the outer interface arrangement comprises a piston seal portion with at least one seal arranged for sealing on an axial surface of at least one of the outer interface arrangement, a wall of the cryostat, and the sock for creating a vacuum seal.

10. A cryocooler mounting arrangement according to claim 8 in which the outer interface arrangement comprises a cable passage for providing a path for electrical cables from an exterior of the sock into an interior of the sock.

11. A cryostat arrangement according to claim 2 comprising retaining means for retaining the clamping ring in position for acting on the fingers, wherein the retaining means comprises a respective retaining shoulder portion provided on at least one of the plurality of fingers.

12. A cryostat arrangement according to claim 2 in which at least one of the plurality of fingers comprises a respective recess in which the clamping ring is located for holding the clamping ring in position.

13. A cryostat arrangement according to claim 12 in which a respective recess is provided in each of the fingers.

14. A cryostat arrangement according to claim 2 in which the interface portion comprising the plurality of fingers comprises a cup shaped portion with a first radially extending portion and depending from this a flared cylindrical portion which comprises the plurality of fingers.

15. A cryostat arrangement according to claim 14 in which the cup shaped portion is of a single piece of material.

16. A cryostat arrangement according to claim 2 further comprising a ring-like outer interface arrangement for location between the cryocooler and an outer wall of the cryostat, the ring-like outer interface arrangement being arranged to be located around an aperture in the outer wall of the cryostat through which the coldhead passes when located into the sock.

17. A cryostat arrangement according to claim 16 in which the outer interface arrangement comprises a piston seal portion with at least one seal arranged for sealing on an axial surface of at least one of the outer interface arrangement, a wall of the cryostat, and the sock for creating a vacuum seal.

18. A cryostat arrangement according to claim 16 in which the outer interface arrangement comprises a cable passage for providing a path for electrical cables from an exterior of the sock into an interior of the sock.

19. A cryostat arrangement comprising a cryostat arrangement according to claim 2 and comprising a super conducting magnet housed in the cryostat.

20. A cryocooler mounting method for mounting a coldhead of a cryocooler in a cryostat for allowing the extraction of heat from an interior of the cryostat by the cryocooler, the method comprising the steps of:

providing a coldhead interface portion on the cold head;

providing a sock portion in the cryostat, wherein said sock portion is arranged for receiving the coldhead, the sock portion comprising a receiving interface portion for receiving the coldhead interface portion so as to provide thermal contact between the receiving interface portion and the coldhead interface portion and to provide thermal contact between the cold head and the interior of the cryostat;

wherein the coldhead interface portion comprises a plurality of flexible finger portions and the receiving interface portion comprises a bearing surface against which the finger portions are arranged to rest, wherein the receiving interface portion further includes an annular recess into which the plurality of flexible finger portions of the coldhead interface extend; and the method comprises the further steps of locating the finger portions on the bearing surface; and releasably clamping the finger portions against the bearing surface using a clamping ring to ensure thermal contact between the coldhead interface and the receiving interface.

21. A cryostat arrangement comprising a cryostat and a two-stage cryocooler having a coldhead for mounting in the cryostat for allowing the extraction of heat from an interior of the cryostat by the cryocooler, the cryostat arrangement comprising two coldhead interface portions provided on the coldhead and a sock portion mounted in the cryostat and arranged for receiving the coldhead, the sock portion comprising two receiving interface portions, a first of the two receiving interface portions for receiving a first of the two coldhead interface portions and a second of the two receiving interface portions for receiving a second of the two coldhead interface portions so as to provide thermal contact between the two receiving interface portions and the two coldhead interface portions and hence to provide thermal contact between the coldhead and the interior of the cryostat, wherein each of the two coldhead interface portions comprises a plurality of flexible finger portions and each of the two receiving interface portions comprises a bearing surface against which the respective finger portions of the two coldhead interface portions are arranged to rest, wherein each of the two receiving interface portions includes an annular recess into which the respective plurality of flexible finger portions of the respective coldhead interface extend;

and the cryostat arrangement further comprising two clamping rings, a first of the two clamping rings for releasably clamping the plurality of finger portions of the first of the two coldhead interface portions against the bearing surface of the first of the two receiving interface portions to ensure thermal contact between the first coldhead interface portion and the first receiving interface portion, and a second of the two clamping rings for releasably clamping the plurality of finger portions of the second of the two coldhead interface portions against the bearing surface of the second of the two receiving interface portions to ensure thermal contact between the second coldhead interface portion and the second receiving interface portion.

22. A cryocooler arrangement according to claim 1, wherein the bearing surface is conical and the plurality of flexible finger portions are arranged so as to lie on a complementary conical surface so that in engaging the interfaces the fingers slide over the bearing surface.

23. A cryocooler arrangement according to claim 1, wherein the coldhead interface portion is mounted to a flange of a commercially available coldhead.

24. A cryocooler arrangement according to claim 1, wherein the coldhead interface portion is integrally formed with the coldhead.

25. A cryocooler arrangement according to claim 1, wherein the bearing surface is tapered and inner engaging walls of the plurality of flexible finger portions define a complementary taper.

26. A cryocooler arrangement according to claim 1, wherein the clamping ring is of polytetrafluoroethylene (PTFE).

27. A cryocooler arrangement according to claim 1, wherein the clamping ring comprises a recess in which a heating wire is located.

28. A cryocooler arrangement according to claim 1, wherein the plurality of flexible finger portions and the clamping ring extend at least partially into the annular recess of the receiving portion.

29. A cryocooler arrangement according to claim 1, wherein the sock portion comprises a curved wall portion providing a vacuum chamber within which the coldhead resides and wherein the sock portion terminates with the receiving interface portion such that the interior of the sock is sealed from the interior of the cryostat.

30. A cryostat arrangement according to claim 2, wherein the bearing surface is conical and the plurality of flexible finger portions are arranged so as to lie on a complementary conical surface so that in engaging the interfaces the fingers slide over the bearing surface.

31. A cryostat arrangement according to claim 2, wherein the coldhead interface portion is mounted to a flange of a commercially available coldhead.

32. A cryostat arrangement according to claim 2, wherein the coldhead interface portion is integrally formed with the coldhead.

33. A cryostat arrangement according to claim 2, wherein the bearing surface is tapered and inner engaging walls of the plurality of flexible finger portions define a complementary taper.

34. A cryostat arrangement according to claim 2, wherein the clamping ring is of polytetrafluoroethylene (PTFE).

35. A cryostat arrangement according to claim 2, wherein the clamping ring comprises a recess in which a heating wire is located.

36. A cryostat arrangement according to claim 2, wherein the plurality of flexible finger portions and the clamping ring extend at least partially into the annular recess of the receiving portion.

37. A cryostat arrangement according to claim 2, wherein the sock portion comprises a curved wall portion providing a vacuum chamber within which the coldhead resides and wherein the sock portion terminates with the receiving interface portion such that the interior of the sock is sealed from the interior of the cryostat.

38. A cryostat arrangement according to claim 21, wherein the sock portion comprises two curved wall portions providing a vacuum chamber within which the coldhead resides and wherein a first of the two curved wall portions terminates with a first of the two receiving interface portions and a second of the two curved wall portions terminates with a second of the two receiving interface portions such that the interior of the sock is sealed from the interior of the cryostat.

* * * * *